US006835094B2

(12) United States Patent
Matsushita

(10) Patent No.: US 6,835,094 B2
(45) Date of Patent: Dec. 28, 2004

(54) CONNECTOR AND A CONNECTOR ASSEMBLY

(75) Inventor: Yasuo Matsushita, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/717,126

(22) Filed: Nov. 19, 2003

(65) Prior Publication Data

US 2004/0106323 A1 Jun. 3, 2004

(30) Foreign Application Priority Data

Nov. 19, 2002 (JP) ..... 2002-335250
Nov. 20, 2002 (JP) ..... 2002-336295

(51) Int. Cl.[7] ..... H01R 13/73
(52) U.S. Cl. ..... 439/559; 439/271
(58) Field of Search ..... 439/373, 374, 439/271–275, 538, 544, 552, 556, 559, 560

(56) References Cited

U.S. PATENT DOCUMENTS 3,675,185 A * 7/1972 Ruehlemann et al. ..... 439/564
5,080,598 A * 1/1992 Shotey ..... 439/147
5,139,431 A * 8/1992 Saitoh et al. ..... 439/364
5,487,680 A 1/1996 Yamanashi
5,775,944 A 7/1998 Flask et al.
5,980,291 A * 11/1999 Ono ..... 439/247

FOREIGN PATENT DOCUMENTS

JP 7-53269 12/1995

* cited by examiner

*Primary Examiner*—Gary Paumen
*Assistant Examiner*—James R. Harvey
(74) *Attorney, Agent, or Firm*—Gerald E. Hespos; Anthony J. Casella

(57) ABSTRACT

A female housing (20) connectable with a male housing (10) to be mounted on a panel (P) is provided with a terminal-accommodating portion (21) for accommodating terminal fittings (29). A jaw (22) bulges out from the outer surface of the terminal-accommodating portion (21) over the entire circumference to face the panel (P) substantially in parallel. A grommet (23) is attached to the jaw (22) and is held in close contact with the panel (P) by being present between the panel (P) and the jaw (22). A protrusion (40) is provided on the jaw (22) to surround the terminal-accommodating portion (21).

9 Claims, 9 Drawing Sheets

CONNECTOR AND A CONNECTOR ASSEMBLY

BACKGROUND OF THE INVENTION

1. Field of the Invention

The invention relates to a connector assembly mountable on a panel.

2. Description of the Related Art

Japanese Utility Model Examined Publication No. 7-53269 and FIG. 9 herein disclose a connector that is mountable on a panel. With reference to FIG. 9, the connector has a waiting-side male housing 2 to be mounted on a panel 1 and an assembling-side female housing 3 to be connected with the male housing 2. The female housing 3 has a terminal accommodating portion 4 with a vertically long rectangular outer shape. A jaw 5 bulges out from the rear end of the terminal accommodating portion 4 and faces the panel 1 in parallel. Female terminal fittings (not shown) are accommodated in the terminal accommodating portion 4, and wires 6 are drawn out through the rear surface of the terminal accommodating portion 4 to extend backward. The female housing 3 is covered from behind by a grommet 7 that engages the outer peripheral edge of the jaw 5. A leading end of the grommet 7 is widened and held in close contact with the panel 1 for sealing.

The jaw 5 of the connector may twist due to thermal shrinkage after molding or an external force during the use. The jaw 5 then loses its flatness and cannot face the panel 1 in parallel. Thus, there is a possibility that the leading end of the grommet 7 cannot be held securely in close contact with the panel 1 when the grommet 7 is attached to the jaw 5, thereby impairing its sealing ability.

The invention was developed in view of the above problem and an object thereof is to provide a connector that can mount and seal to a panel.

SUMMARY OF THE INVENTION

The invention relates to a connector with a housing configured for mounting on a panel. The housing includes a terminal-accommodating portion for accommodating terminal fittings. A jaw bulges from an outer peripheral surface of the terminal accommodating portion, and preferably extends over substantially the entire periphery. The jaw faces the panel and is substantially parallel to the panel. A grommet is attached to the jaw and is held in close contact with the panel. At least one protrusion is provided on the jaw, and continuously or discontinuously surrounds the terminal-accommodating portion.

The protrusion reinforces the jaw and suppresses twisting or warping due to thermal shrinkage after molding or due to external forces during use. Thus, the jaw remains substantially flat and can be substantially parallel to the panel. Accordingly, the grommet can be attached to the jaw and held in close contact with the panel to ensure good sealing.

The protrusion is at an inner side of a panel-facing surface of the jaw covered by the grommet. Thus, the protrusion does not interfere with the grommet, and the grommet can be attached firmly to the jaw without moving onto the protrusion in a manner that would create a clearance.

The jaw has different length and width dimensions, and the longer sides of the jaw are prone to twisting or warping. However, crossing portions cross at least part of areas of the jaw along the longer sides inside the annular portion. The crossing portions suppress twisting and warping.

A projecting distance of the protrusion is sufficiently short to avoid interference with a receptacle of the mating housing when the housing is connected properly with the mating housing.

At least two protrusions preferably are formed on a panel-facing surface and an opposite surface of the jaw. The two protrusions preferably are substantially symmetrical on the jaw.

The protrusion preferably has at least one substantially U-shaped outer portion arranged substantially parallel to an inner wall that is substantially continuous with the outer peripheral wall of the terminal-accommodating portion.

The protrusion may comprise couplings at intervals along the peripheral direction of the outer portion to couple the outer portion and the inner wall.

The invention also relates to a connector assembly comprising the above-described connector and a mating connector that has a housing to be mounted on a panel. A lock arm preferably is provided on one of the housings and forms an inertial locking means. More particularly, the lock arm temporarily contacts an engaging portion for temporarily restricting the connection of the two housings. The contact state is canceled by pushing the housing and/or the mating housing with a force exceeding a connection resistance.

These and other features of the invention will become more apparent upon reading of the following detailed description of preferred embodiments and accompanying drawings. Even though embodiments are described separately, single features may be combined to additional embodiments.

DETAILED DESCRIPTION OF THE PREFERRED EMBODIMENTS

Figure 6:
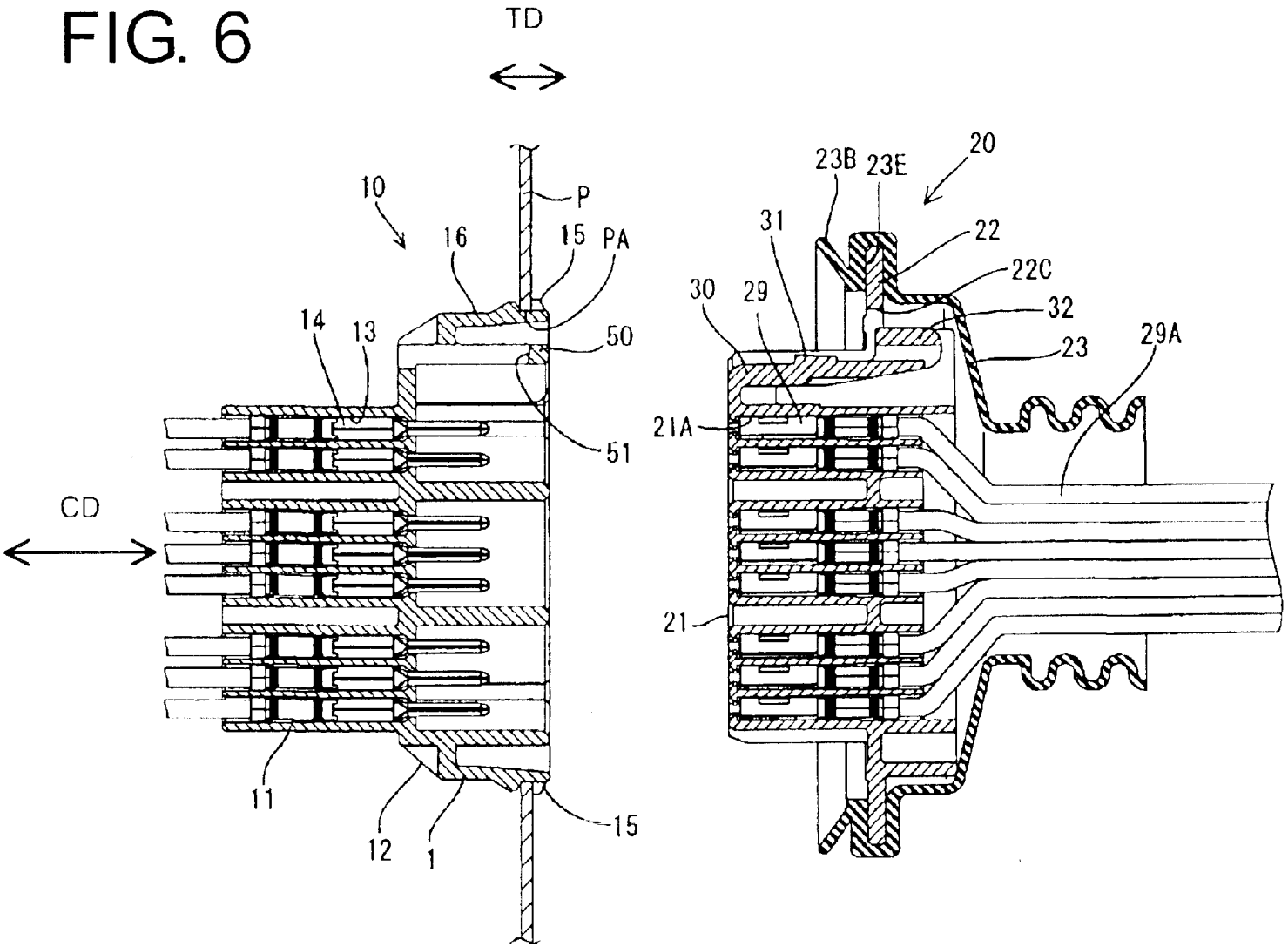
FIG. 6 is a section showing a state before the housings are connected.

A connector according to one embodiment of the invention is described with reference to FIGS. 1 to 8. The connector, as shown in FIG. 6, is comprised of a waiting-side male housing 10 mountable on a panel P e.g. of a door of an automotive vehicle and an assembling-side female housing 20. The female housing 20 is connectable along a connecting direction CD with the male housing 10. In the following description, sides of the male and female housings 10, 20 to be connected are referred to as the front.

The male housing 10, as shown in FIG. 6, has a tall main body 11 and a tall rectangular tubular receptacle 12 projects forward from the main body 11. Cavities 13 are formed inside the main body 11, and male terminal fittings 14 are accommodated in the cavities 13 so that leading ends of the male terminal fittings 14 project into the receptacle 12.

Figure 1:
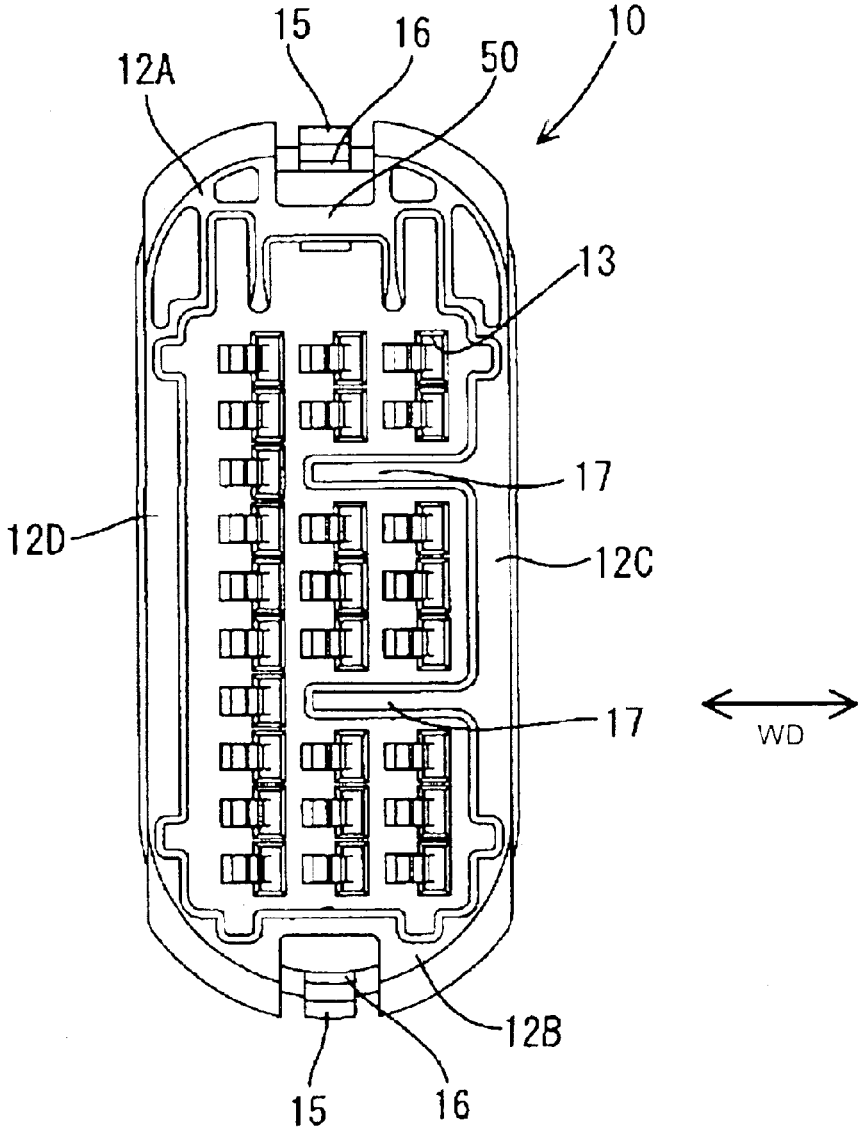
FIG. 1 is a front view of a male housing of a connector according to one embodiment of the invention.
Figure 2:
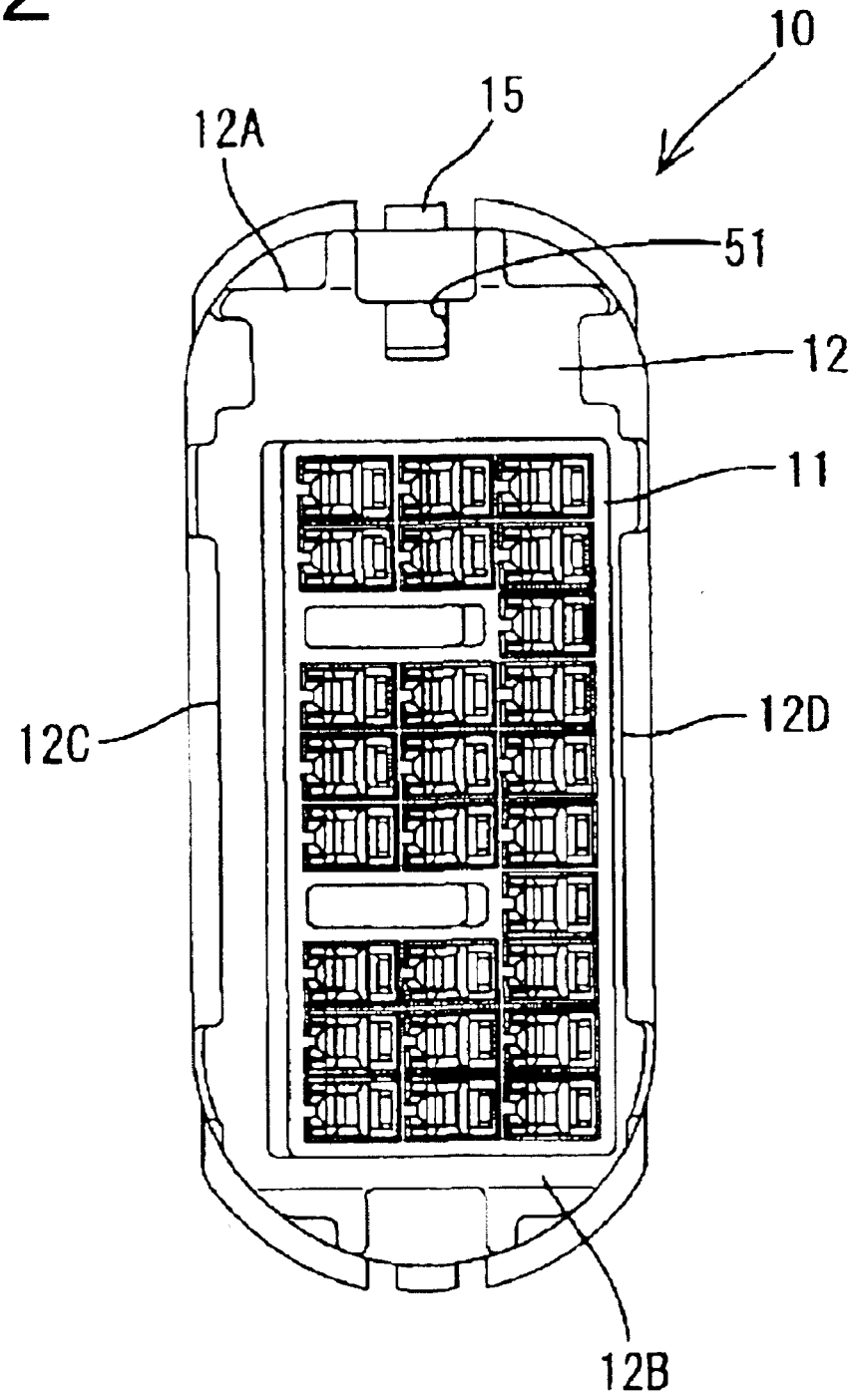
FIG. 2 is a rear view of the male housing.

The male housing 10 is fit to a mount opening PA in a panel P from behind the panel P and is secured to the panel P by upper and lower locking claws 15. As shown in FIG. 1, each locking claw 15 is formed with a claw for tightly holding the panel P in a thickness direction TD. The locking claws 15 are formed at the leading ends of resilient pieces 16 substantially at widthwise-middle positions of upper and lower walls 12A, 12B of the receptacle 12. An engaging portion 50 is forming at the opening edge of the receptacle 12 at a position on the upper wall 12A of the receptacle 12 substantially facing the locking claw 15 in the deforming direction of the locking claw 15. A locking hole 51 is formed in the upper wall 12A of the receptacle 12 behind the engaging portion 50 as seen along a connecting direction CD and as shown in FIG. 6.

As shown in FIG. 1, the receptacle 12 has left and right vertically tall side walls 12C, 12D. Two plate-shaped shelves 17 project in substantially along the widthwise direction WD from the side wall 12C to partly cross the receptacle 12. The shelves 17 are substantially parallel and are at two vertically spaced positions on the side wall 12C of the receptacle 12. Additionally, the shelves 17 extend from the front end of the receptacle 12 to the rear end thereof.

The female housing 20, as shown in FIG. 6, has a terminal-accommodating portion 21 with cavities 21A for accommodating female terminal fittings 29. A jaw 22 bulges out over substantially the entire outer periphery of the terminal-accommodating portion 21 near the rear end. The jaw 22 is in opposed substantially parallel relationship to the panel P when the female housing 20 is connected with the male housing 10 and is sealed to the panel P by a grommet 23.

Figure 8:
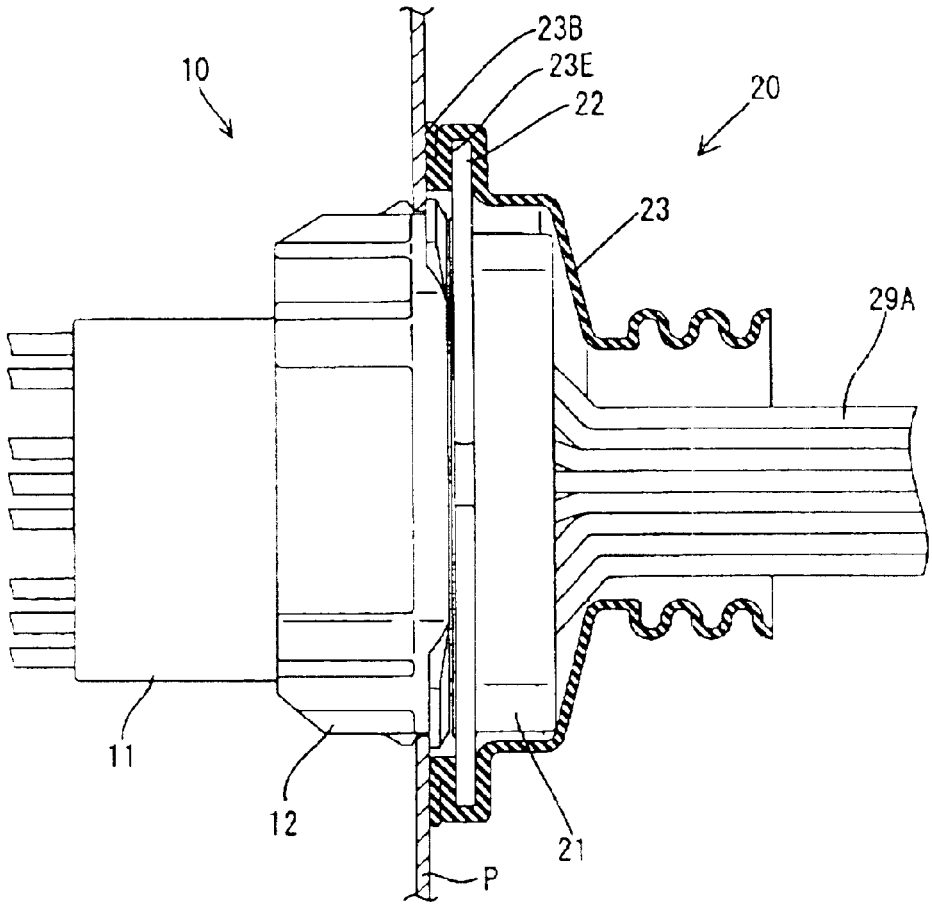
FIG. 8 is a side view showing the state where the male and female housings are at the proper connection position.
Figure 9:
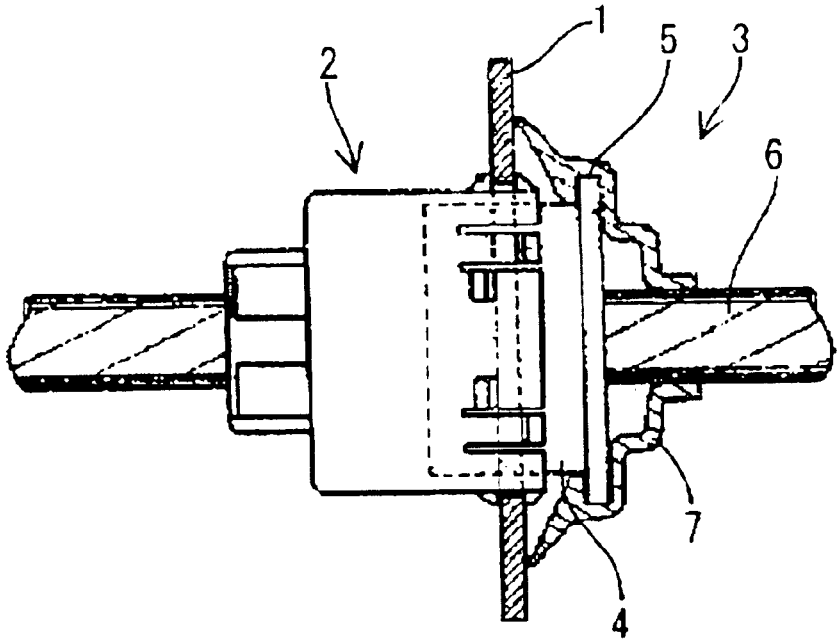
FIG. 9 PRIOR ART
FIG. 9 is a side view of a prior art connector.

The grommet 23 is attached to the jaw 22 from behind the female housing 20, which is a side opposite to a side that faces the panel P. Additionally, the grommet 23 covers a part of the female housing 20 from the jaw 22 to the rear surface of the terminal-accommodating portion 21. Wires 29A are drawn out through the rear surface of the terminal-accommodating portion 21. A mount groove 23E is formed near the front end of the grommet 23 and has a substantially V- or U-shaped cross section. The mount groove 23E is formed over substantially the entire periphery, as shown in FIG. 6, to hold the outer peripheral edge of the jaw 22 tightly from opposite sides along the thickness direction TD of the panel P. A seal 23B is provided at a front end of the grommet 23 and diverges toward the front. This seal 23B is pressed between the jaw 22 and the panel P from front and back sides, and is held in close contact with the panel P, as shown in FIG. 8, when the female housing 20 is connected with the male housing 10. In this way, sealability of the female housing 20 is secured.

Figure 3:
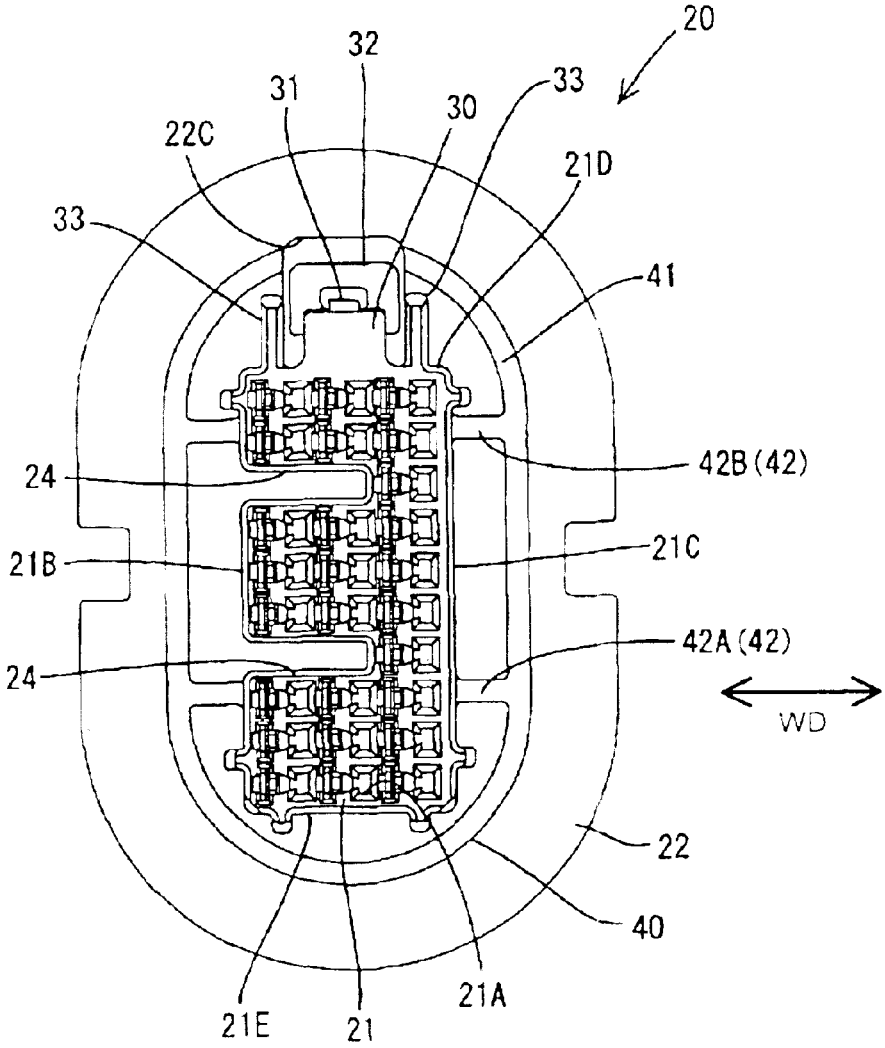
FIG. 3 is a front view of a female housing.

The terminal-accommodating portion 21, as shown in FIG. 3, has different external vertical and horizontal dimensions. More particularly, the terminal-accommodating portion 21 has left and right long sides 21B, 21C and upper and lower short sides 21D, 21E. Thus, the terminal-accommodating portion 21 has a vertically long substantially rectangular cross section. Substantially parallel cuts 24 are made in the terminal-accommodating portion 21 at vertically spaced positions of the left long side 21C shown in FIG. 3. The shelves 17 in the receptacle 12 of the male housing 10 align with and fit in the cuts 24 when the male and female housings 10 and 20 are connected. As a result, upside-down connection of the housings 10, 20 is prevented due to the asymmetric arrangement of the shelves 17 and cuts 24.

A lock arm 30 is cantilevered from a widthwise-middle of the upper short side 21D of the terminal-accommodating portion 21. The lock arm 30 projects up from the front end of the terminal-accommodating portion 21 and then extends back along the connecting direction CD through an introducing hole 22C in the jaw 22, as shown in FIG. 6. The extending end of the lock arm 30 reaches a position near the rear surface of the terminal-accommodating portion 21. A portion of the lock arm 30 exposed backward through the introducing hole 22C serves as an operable portion 32 for operating the lock arm 30. A lock 31 projects at a substantially middle position of the lock arm 30 with respect to its extending direction and has a front surface aligned substantially normal to the connecting direction CD. The lock arm 31 contacts the front surface of the engaging portion 50 in the male housing 10 in the process of connecting the two housings 10, 20, and the two housings 10, 20 are connected with a single stroke by a force created when the contact state is canceled. The two housings 10, 20 reach a proper connection position by this inertial force. The lock 31 engages the rear surface 51 of the engaging portion 50 at the connection position and the female housing 20 is locked into the male housing 10. Restricting walls 33 project from the upper short side 21D at opposite sides of the lock arm 30, as shown in FIG. 3. The restricting walls 33 prevent a wire or the like from entering a clearance between the lock arm 30 and the shorter side 21D and restrict inadvertent disengagement of the lock arm 30

The jaw 22 is a vertically tall plate with a substantially elliptical shape that substantially conforms to the rectangular cross section of the terminal-accommodating portion 21. A front protrusion 40 is provided on the front surface of the jaw 22 and extends out from the long sides 21B, 21C of the terminal-accommodating portion 21. Thus, the front protrusion 40 substantially surrounds the terminal-accommodating portion 21. The front protrusion 40 projects a sufficiently short distance to avoid interference with the opening edge of the receptacle 12 of the male housing 10 when the housings 10 and 20 are connected The front protrusion 40 is comprised of an annular portion 41 arranged substantially around the terminal accommodating portion 21 and crossing portions 42 that cross areas of the jaw 22 along the long side within the annular portion 41 in a widthwise direction WD. The crossing portions 42 include lower and upper crossing portions 42A and 42B. The lower crossing portions 42A are above the bottom end of the jaw 22 by about ⅓ of the height of the jaw 22. The upper crossing portions 42B are above the lower crossing portions 42A by about ⅓ of the height of the jaw 22. The crossing portions 42A, 42B are substantially parallel and extend along the widthwise direction WD. Each of the crossing portions 42A and 42B has one end connected with the rear end of the terminal-accommodating portion 21 and the other end connected with the annular portion 41.

The annular portion 41 is substantially elliptical and is spaced from the terminal-accommodating portion 21. However, the annular portion 41 is interrupted by the introducing hole 22C for the lock arm 30. The front protrusion 40 reinforces the jaw 22 and prevents twisting or warping of the jaw 22 due to thermal shrinkage after molding or external forces during the use. Therefore, the jaw 22 remains flat.

Figure 4:
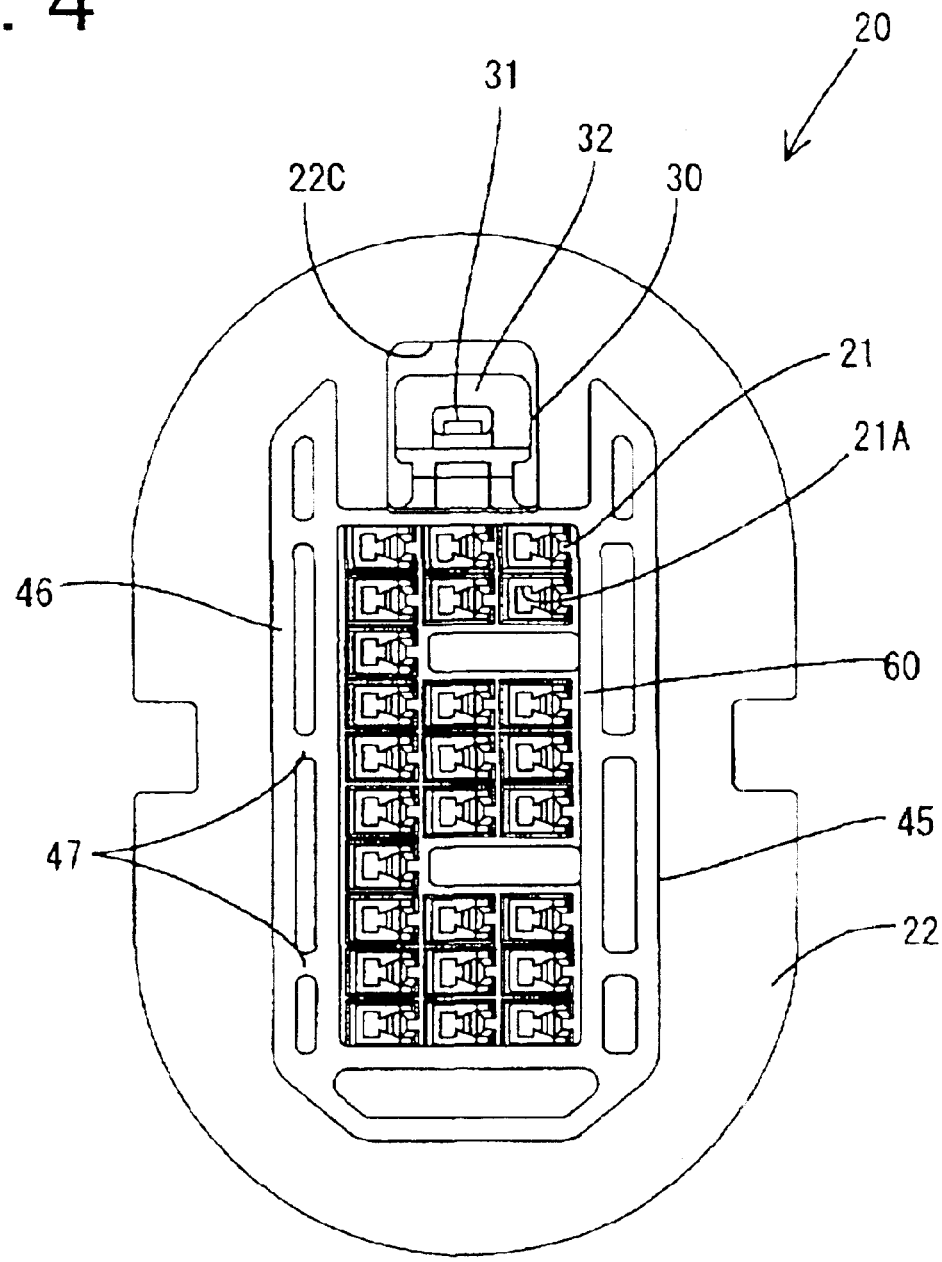
FIG. 4 is a rear view of the male housing.
Figure 5:
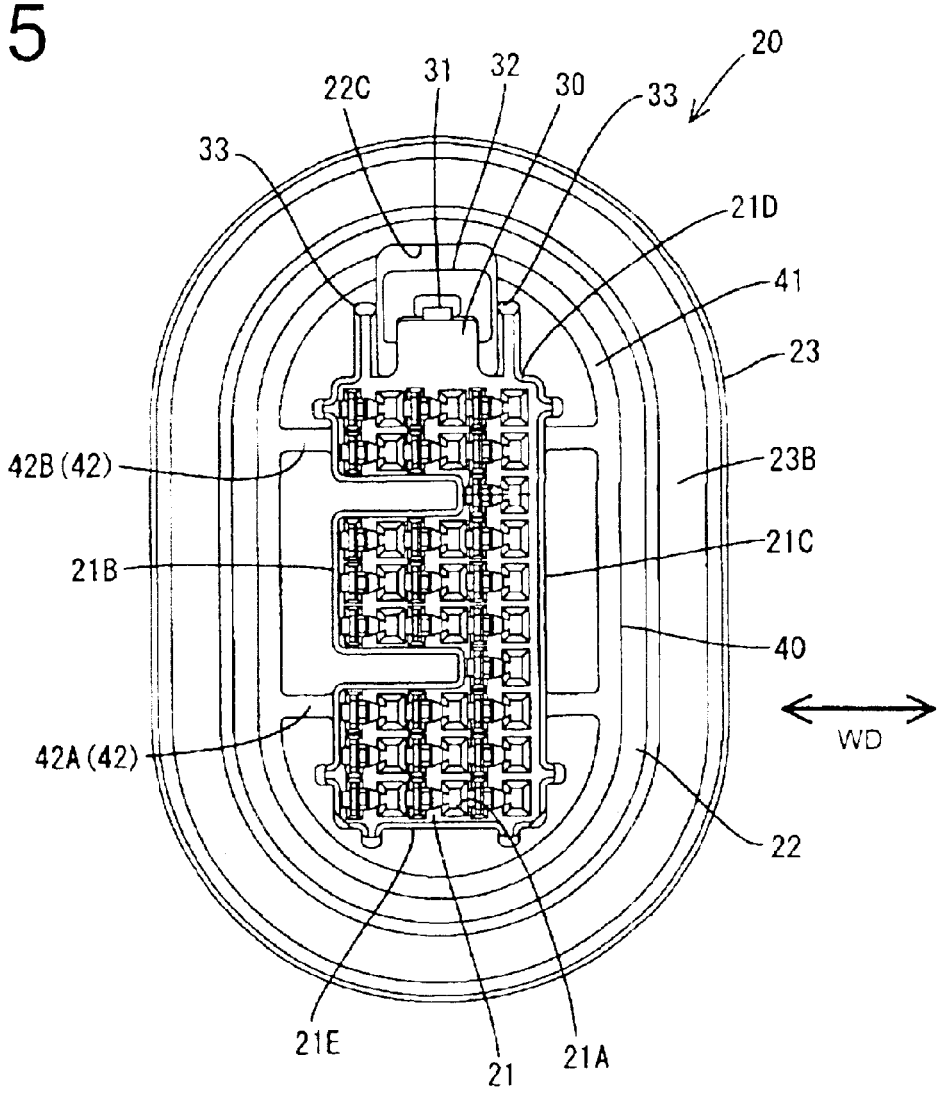
FIG. 5 is a front view showing a state where a grommet is attached to the female housing.

An inner wall 60 projects from the rear surface of the jaw 22, as shown in FIG. 4, and is continuous with the outer peripheral wall of the terminal-accommodating portion 21. A rear protrusion 45 projects from the rear surface of the jaw 22 outside the inner wall 60 and projects substantially the same distance as the inner wall 60. The rear protrusion 45 has at least one substantially U-shaped outer portion 46 arranged substantially parallel with the inner wall 60. Couplings 47 are provided at specified intervals along the periphery of the outer portion 46 to couple the outer portion 46 and the inner wall 60. The outer portion 46 is at substantially the same position on the rear surface of the jaw 22 as the annular portion 41 on the front surface of the jaw 22. The outer portion 46 and the annular portion 41 are substantially symmetrical on the front and rear surfaces of the jaw 22. The couplings 47 correspond to the crossing portions 42 on the front surface of the jaw 22. The jaw 22 is reinforced strongly by the rear and front protrusions 45, 40 together, and twisting or warping of the jaw 22 are suppressed.

The male terminal fittings 14 are accommodated in the cavities 13 of the male housing 10, and the female terminal fittings 29 are accommodated in the cavities 21A of the female housing 20. The grommet 23 then is mounted on the female housing 20 and the male housing 10 is mounted on the inner surface of the panel P.

Figure 7:
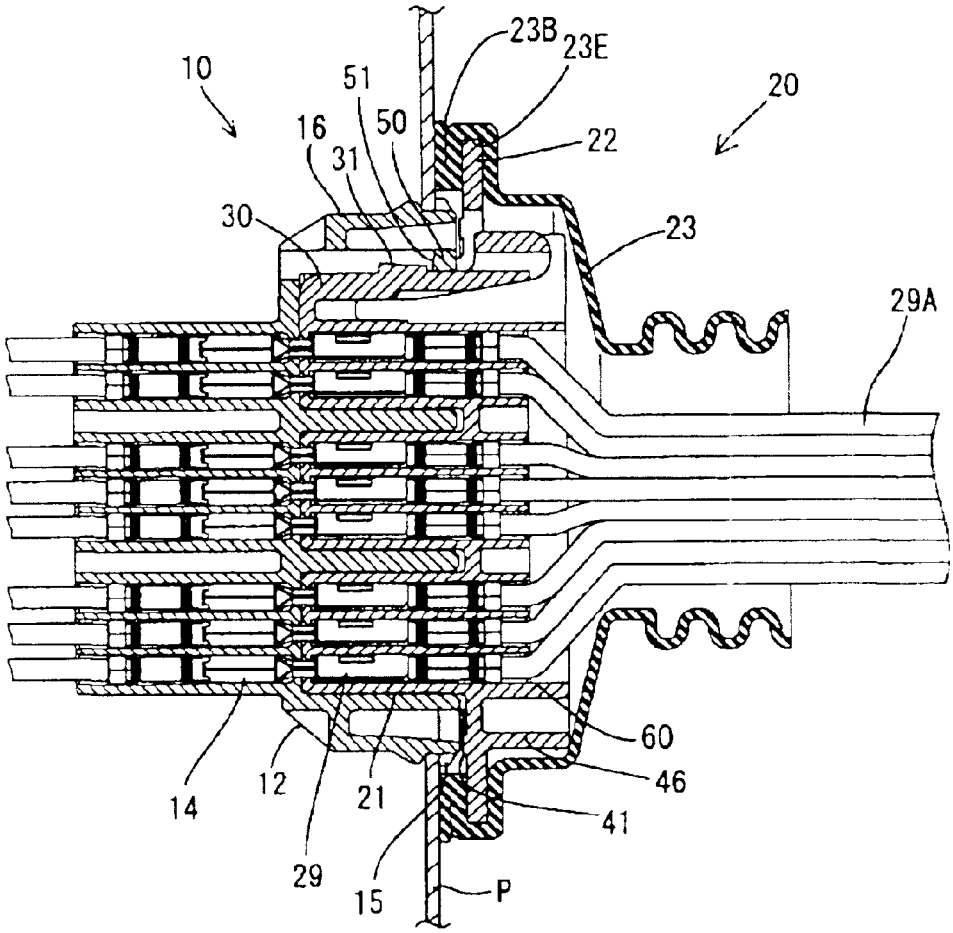
FIG. 7 is a section showing a state where the male and female housings are at a proper connection position.

The two housings 10, 20 are arranged so that the engaging surfaces oppose each other, as shown in FIG. 6, and the terminal-accommodating portion 21 of the female housing 20 is fit into the receptacle 12 of the male housing 10. The male housing 10 is pushed to an intermediate position in the receptacle 12 so that the lock 31 of the lock arm 30 contacts the front surface of the engaging portion 50, thereby temporarily restricting connection of the housings 10, 20. The contact state is canceled by pushing the female housing 10 with a force that exceeds the connection resistance. Connection of the housings 10, 20 proceeds with a single stroke due to inertia when the contact state is canceled. As a result, the female housing 20 is guided to a proper connection position. The lock 31 fits in the locking hole 51 and engages the rear surface of the engaging portion 50 at the proper connection position and the front surface of the terminal accommodating portion 21 is held in contact with the back surface of the receptacle 12, as shown in FIG. 7. As a result, the female housing 20 is locked in the male housing 10 and the terminal fittings 14, 29 are connected electrically. Additionally, the jaw 22 and the panel P face each other and are substantially parallel at the proper connection position. Thus, the sealing portion 23B of the grommet 23 is squeezed between the jaw 22 and the panel P and is held in close contact with the panel P as shown in FIG. 8, thereby displaying its sealing ability.

The front and rear protrusions 40, 45 on the jaw 22 substantially surround the terminal accommodating portion 21 and reinforce the jaw 22. Thus, the jaw 22 is less likely to twist and warp due to thermal shrinkage after molding or an external force during use. Accordingly, the jaw 22 remains substantially flat and faces the panel P substantially in parallel. As a result, the grommet 23 closely contacts the panel P and achieves good sealing.

The front protrusion 40 is at the inner side of the area of the front surface of the jaw 22 to be covered by the grommet 23, and therefore does not interfere with the grommet 23. Thus, the grommet 23 can be attached firmly to the jaw 22 without moving onto the front protrusion 40 to create a clearance.

The jaw 22 has different length and width dimensions, and twisting and warping are possible on the longer sides of the jaw 22. However, the crossing portions 42A, 42B at least partly cross the jaw 22 along the longer sides in the width direction. Thus, twisting and warping along the longer sides is suppressed.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The annular portion is interrupted at the introducing hole in the foregoing embodiment. However, the annular portion may be provided continuously while avoiding the introducing hole. Further, the annular portion may take a right circular shape or a polygonal shape.

The protrusion may be only on one surface of the jaw.

It is sufficient for the crossing portions to transversely cross the areas of the jaw along the longer sides. For example, the crossing portions may extend in oblique direction. They need not be separated into the upper crossing portions and lower crossing portions.

The front protrusion may consist only of the annular portion without having the crossing portions.

What is claimed is:

1. A connector, comprising:

a housing connectable with a mating housing mounted on a panel, the housing including a terminal-accommodating portion for accommodating terminal fittings and a jaw bulging out from an outer peripheral surface of the terminal-accommodating portion, the jaw having a front surface for facing the panel substantially in parallel, a rear surface opposite the front surface and an outer peripheral edge extending between the front and rear surfaces;

a grommet attached to the jaw and overlying the outer peripheral edge of the jaw and portions of the front and rear surfaces of the jaw adjacent the outer peripheral edge, the portions of the grommet overlying the front surface of the jaw for closely contacting the panel; and at least one protrusion on the front surface of the jaw inwardly from the portion of the grommet overlying the front surface of the jaw and at least partly surrounding the terminal-accommodating portion such that portions of the jaw having the protrusion are thicker than portions of the jaw to which the grommet is attached, a projecting distance of the protrusion being less than a thickness of portions of the grommet overlying the front surface of the jaw so that the protrusion does not affect the close contacting of the grommet with the panel.

2. The connector of claim 1, wherein the jaw has different length and width dimensions, the protrusion including a peripheral portion substantially surrounding the terminal-accommodating portion, and crossing portions extending in from longer sides of the peripheral portion.

3. The connector of claim 1, wherein a projecting distance of the protrusion is sufficiently short to avoid interference with a receptacle of the mating housing when the housing is connected with the mating housing.

4. The connector of claim 1, wherein the at least one protrusion is a front protrusion, the connector further comprising at least one rear protrusions formed on the rear surfaces of the jaw.

5. The connector of claim 4, wherein the two protrusions are provided substantially symmetrically on the jaw.

6. The connector of claim 4, wherein the rear protrusion comprises at least one substantially U-shaped outer portion arranged substantially parallel to the outer peripheral wall of the terminal-accommodating portion.

7. A connector of comprising:

a housing connectable with a mating housing mounted on a panel, the housing including a terminal-accommodating portion for accommodating terminal fittings and a jaw bulging out from an outer peripheral surface of the terminal-accommodating portion, the jaw having a front surface for facing the panel substantially in parallel;

a grommet attached to the jaw and overlying a portion of the front surface of the jaw for closely contacting the panel; and at least one protrusion on the jaw and at least partly surrounding the terminal-accommodating portion, the at least one protrusion comprising at least one substantially U-shaped outer portion arranged substantially parallel to the outer peripheral surface of the terminal accommodating portion, an inner wall extending continuously rearwardly from the terminal-accommodating portion, and couplings extending between the outer portion and the inner wall at specified intervals.

8. A connector assembly comprising the connector of claim 1 and a mating connector having a mating housing for mounting on a panel.

9. The connector assembly of claim 8, wherein a lock arm is provided on one of the housings to form an inertial locking means by temporarily contacting an engaging portion thereby temporarily restricting connection of the housings, wherein the contact state is canceled by pushing at least one of the housing and the mating connector housing with a force exceeding a connection resistance.

* * * * *